US007080758B2

(12) United States Patent
Jones

(10) Patent No.: US 7,080,758 B2
(45) Date of Patent: Jul. 25, 2006

(54) SUPPORT PANEL FOR BAG IN BOX PACKAGE

(75) Inventor: Ronald Archibald Jones, Stellenbosch (ZA)

(73) Assignee: Tap-It Liquid Solutions (Proprietary) Limited, Stellenbosch (ZA)

( * ) Notice: Subject to any disclaimer, the term of this patent is extended or adjusted under 35 U.S.C. 154(b) by 427 days.

(21) Appl. No.: 10/477,906

(22) PCT Filed: May 3, 2002

(86) PCT No.: PCT/IB02/01499

§ 371 (c)(1),
(2), (4) Date: Nov. 14, 2003

(87) PCT Pub. No.: WO02/092462

PCT Pub. Date: Nov. 21, 2002

(65) Prior Publication Data

US 2004/0124211 A1 Jul. 1, 2004

(30) Foreign Application Priority Data

May 16, 2001 (ZA) ..... 01/3974

(51) Int. Cl.
*B65D 35/56* (2006.01)

(52) U.S. Cl. ..... 222/105; 222/103; 222/95; 222/143; 222/166

(58) Field of Classification Search ..... 222/103, 222/105, 95, 185.1, 81, 181.3, 143, 166
See application file for complete search history.

(56) References Cited

U.S. PATENT DOCUMENTS

| | | | | |
|---|---|---|---|---|
| 3,239,104 | A * | 3/1966 | Scholle | 222/81 |
| 3,902,635 | A * | 9/1975 | Jinotti | 222/103 |
| 4,228,925 | A * | 10/1980 | Mendelovich | 222/103 |
| 4,440,317 | A * | 4/1984 | Clark et al. | 222/103 |
| 4,907,723 | A | 3/1990 | Katz | 222/105 |
| 4,981,238 | A * | 1/1991 | Wenmaekers | 222/103 |
| 5,323,932 | A * | 6/1994 | Bauman | 222/96 |
| 5,342,313 | A * | 8/1994 | Campbell et al. | 604/153 |
| 6,454,132 | B1 * | 9/2002 | Campion | 222/96 |
| 6,554,164 | B1 * | 4/2003 | Jones | 222/105 |

FOREIGN PATENT DOCUMENTS

| | | |
|---|---|---|
| FR | 2 603 029 | 2/1988 |
| WO | WO-92/17374 | 10/1992 |
| WO | WO-01/00504 | 1/2001 |

* cited by examiner

*Primary Examiner*—Patrick Brinson
(74) *Attorney, Agent, or Firm*—Meyertons, Hood, Kivlin, kowert & Goetzel, P.C.; Eric B. Meyertons

(57) ABSTRACT

A primary panel (10) is provided for cooperation with a liquid filled flexible packaging bag during withdrawal intermittently of the contents thereof. The primary panel has at least an operatively forward zone (9) adapted for attachment to a base (3), generally the bottom of a box (1), in a relatively fixed position with respect to the base. A normally inclined zone (10) attached to the forward zone is adapted to flex between a position in which it is generally parallel to the base under conditions corresponding to a full flexible packaging bag and positions in which it is inclined relative to the base under conditions corresponding to a partially filled or substantially empty flexible packaging bag. The inclined zone is resiliently biased relative to the forward zone towards said inclined position. Preferably a pinch panel (19) is provided on a lid (2) to the box and the two panels are arranged to squeeze a liquid filled flexible packaging bag positioned between them during withdrawal of the contents thereof in a progressive manner.

16 Claims, 4 Drawing Sheets

SUPPORT PANEL FOR BAG IN BOX PACKAGE

FIELD OF THE INVENTION

This invention relates to a support panel and box, in particular a dispensing box, for use in conjunction with a liquid filled flexible packaging bag from which it is desired to withdraw the liquid content intermittently in discrete quantities over a period of time. More particularly, the invention relates to an enhanced and improved box for use in housing a packaging bag and support panel of the general type detailed in my published international patent application number WO 01/00504 the content of which is imported herein by reference.

It is to be understood that in this specification the term liquid, and accordingly the term liquid filled, includes not only readily flowable liquids such as water, milk, fruit juice, wine and vinegar but also semi-liquid substances typically encountered in the catering industry such as tomato sauce or ketchup, mayonnaise, mustard and the like as well as semi liquid substances used in the cosmetic, beauty and hair-care industries such as lotions, creams, shampoos, conditioners, and the like.

BACKGROUND TO THE INVENTION

In my said published international patent application I describe a support for a liquid filled packaging bag in which the packaging bag, for the purposes of dispensing the contents intermittently over a period of time, is generally supported on a panel in a generally horizontal orientation but one in which the panel moves to an increasingly inclined orientation as the content of the packaging bag is consumed.

I also describe a box in which such support panel can be located and I further describe a support panel which pivots about its front edge from a generally horizontal position corresponding to a full packaging bag being supported by it to progressively more inclined positions once a portion of the contents of the bag has been consumed.

OBJECT OF THE INVENTION

It is an object of this invention to provide a support panel and box for a liquid filled flexible packaging bag that has enhanced features over those described in my said published international patent application as well as possible additional applications.

SUMMARY OF THE INVENTION

In accordance with one aspect of this invention there is provided a primary panel for cooperation with a liquid filled flexible packaging bag during withdrawal intermittently of the contents thereof, the primary panel comprising at least a normally inclined zone adapted to flex between a position in which it is generally parallel to the base under conditions corresponding to a full flexible packaging bag and one in which it is inclined relative to the base under conditions corresponding to a partially filled or substantially empty flexible packaging bag and wherein the inclined zone is resiliently biased towards said inclined position, the primary panel being characterized in that it has an operatively forward zone adapted for attachment to a base in a relatively fixed forward position with respect to the base and the inclined zone is attached to the forward zone through a flexible zone positioned rearwards of a front edge of the forward zone.

Further features of this aspect of the invention provide for the primary panel to be made as a single plastics injection moulding with the material connecting the forward zone to the inclined zone being adapted to flex resiliently; for the inclined zone to define an intermediate zone communicating at its operatively opposite or rear end with a rear zone orientated approximately in a plane parallel to that of the forward zone; for the forward zone to be provided with one or more catches for attaching it to said base; and for the forward zone to have one or more recessed regions shaped to accommodate a flange of an outlet tap arrangement that may be associated with a liquid filled flexible packaging bag.

In accordance with a second aspect of the invention there is provided a box adapted to receive a primary panel as defined above in a manner in which the forward zone of the primary panel is attached to it in a generally parallel and preferably substantially flush orientation relative to a bottom of the box.

Further features of this aspect of the invention provide for the box to have formations adapted to cooperate with catches on the forward zone of the primary panel in order to retain it in its operative position; for the bottom of the box to have corresponding recesses for receiving recessed regions provided on the forward zone of the primary panel; for the box to have a front wall with one or more openings or removable sections for enabling an outlet tap arrangement to communicate from the interior to the exterior of the box; for the box to have sidewalls at least one half of the height of which is formed integral with the bottom and the remainder of the height of which is formed integral with a lid of the box; for the sidewalls to have a slot formed therein through which the inclination of the inclined zone can be observed as an indication of the quantity of liquid remaining in the packaging bag and, preferably, for the inclined section to have a protrusion passing into and optionally through the slot to facilitate such visual observation; for the bottom, sidewalls and lid of the box to be made as a single integral plastics moulding with an integral hinge joining the lid part of the box and the bottom part of the box; and for the bottom and lid of the box to be provided with co-operating formations for enabling vertical alignment of stacked boxes to be achieved.

Still further and significant features of the invention provide for the lid, at the rear edge thereof, to receive a rear zone of a pinch panel having an inclined zone biased towards the primary panel and a forward zone co-operating with the primary panel so that the content of any liquid filled flexible packaging bag located between them is squeezed somewhat by a pinching action between the two panels; for the pinch panel to have a clip for releasably holding it against its bias in a retracted position against the lid pending release thereof for use; and for the primary panel and pinch panel to be substantially identical with the forward zone of the primary panel corresponding with, and being identical to, the rear zone of the pinch panel.

The primary panel, when used in a generally horizontal orientation in which the bottom of the box is horizontal, forms a support panel as described in my said earlier published patent application. However, in appropriate applications in which there are both a primary panel and a cooperant pinch panel to squeeze the contents of a liquid filled packaging bag located between them, the box may be orientated in a vertical position with the tap of the liquid packaging bag contained therein operatively lowermost. This orientation of the box and resilient panels is envisaged as being particularly useful when applied to the catering industry, the cosmetic and beauty industries, as well as the haircare industry for containing consumables as indicated above. When used in this orientation the box may be supported in a co-operating bracket together with one or more other similar boxes.

In order that the above and other features of the invention may be more fully understood one embodiment thereof will now be described with reference to the accompanying drawings.

DETAILED DESCRIPTION WITH REFERENCE TO THE DRAWINGS

Figure 1:
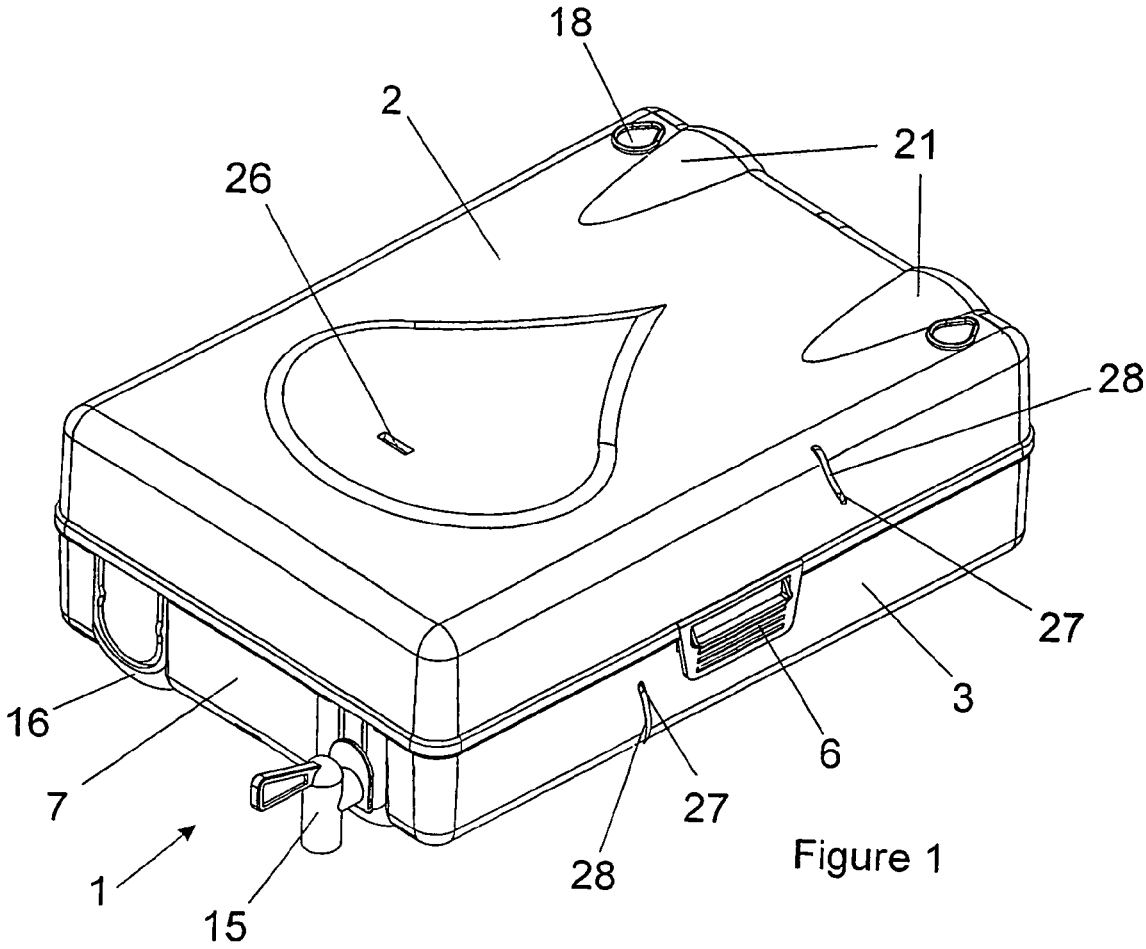
FIG. 1 is an isometric view of a dispensing box according to the invention in the closed but operative condition.
Figure 9:
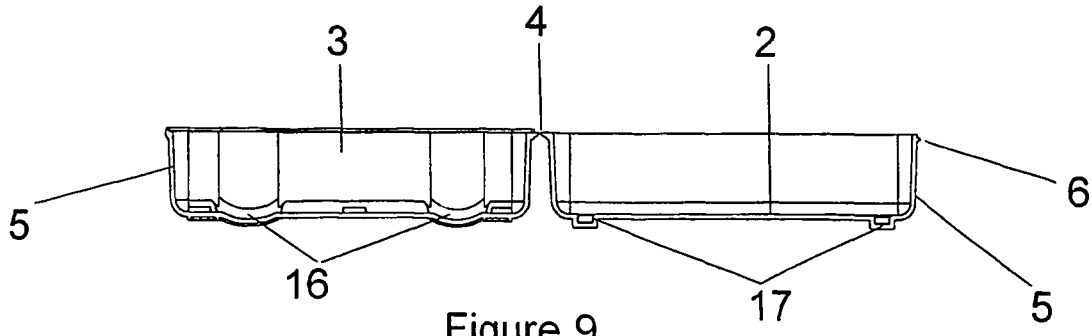
FIG. 9 is a cross-section taken through the box in an open condition adjacent the front wall thereof; and, FIG. 10 is an isometric view illustrating two boxes next to each other supported in a vertical orientation by means of a bracket.

In this embodiment of the invention the box is made as a single injection moulded plastics unit indicated generally by numeral (1) comprising a lid (2) and a bottom part (3) connected together by an integral hinge (4) (see particularly FIG. 9). Each of the lid and bottom part has integral sidewalls (5) having, in the illustrated embodiment, a height equal to one half of the height of the closed box illustrated in FIG. 1. However, it is envisaged that, depending on injection moulding equipment available, it may be more suitable to mould sidewalls having a greater height integral with the bottom part in order to facilitate closing of the box with a full liquid filled flexible packaging bag located in it.

Also moulded integral with the lid and bottom part are co-operating catch formations (6) that cooperate to releasably lock the box in a closed position. The basic shape of the box is such that a liquid filled packaging bag lying in a substantially horizontal orientation and having a length greater than its width will extend rearwards within the box from a front wall (7) which corresponds in its width to the width of the packaging bag and which is shorter than the depth of the box which corresponds to the length of the packaging bag.

Figure 2:
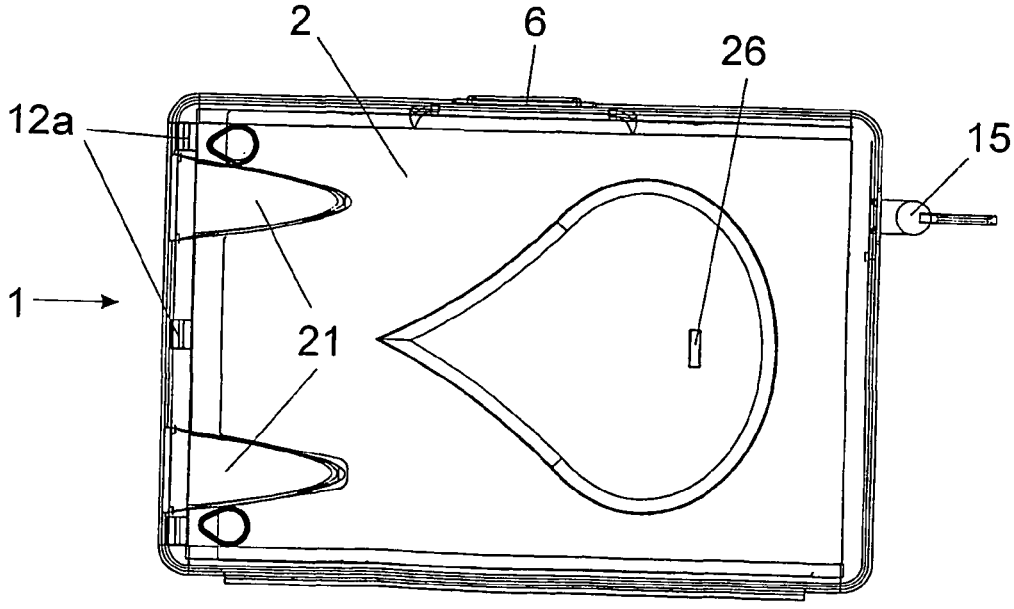
FIG. 2 is a plan view thereof.
Figure 8:
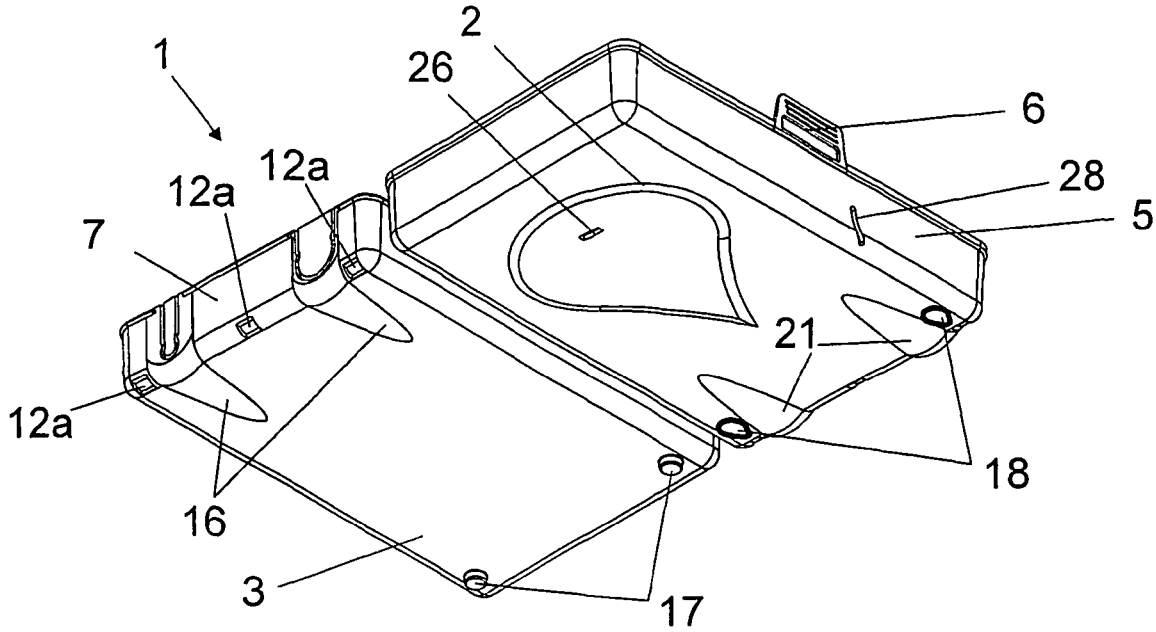
FIG. 8 is an underneath isometric view of the box in an open condition.

An injection moulded primary panel (8) that serves as a support panel (shown clearly in FIGS. 3 to 6) cooperates with the bottom of the box in the following manner. The primary panel is divided into three zones namely a forward zone (9); an intermediate and generally inclined zone (10); and a rear zone (11) orientated in a plane parallel to the forward zone (9). The forward zone (9) has moulded integral therewith a plurality of catches (12) at its front edge that cooperate with formations (12*a*) (see FIGS. 2 and 8) in the bottom of the box to clip the forward zone firmly in position relative to the box.

Figure 3:
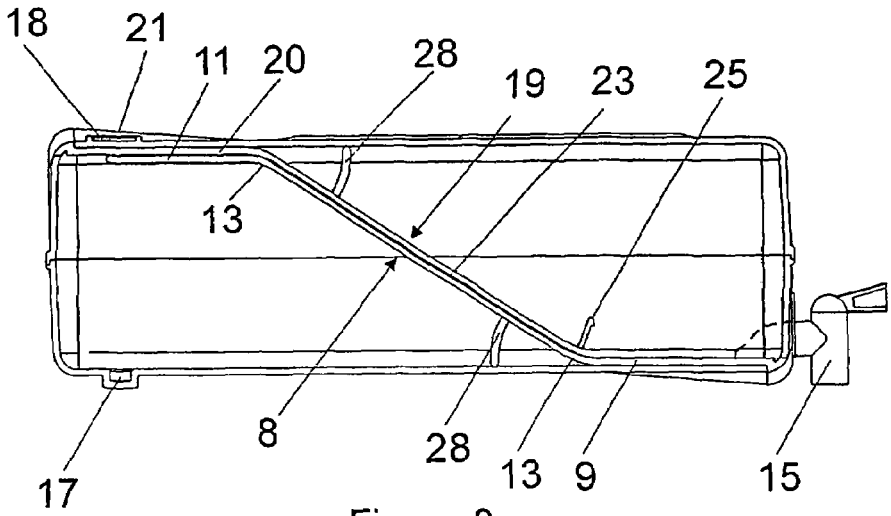
FIGS. 3, 4 and 5 are cross-sections taken through the box and showing the primary panel and pinch panel in three different positions relative to each other according to the amount of liquid contained in a packaging bag within the box.
Figure 4:
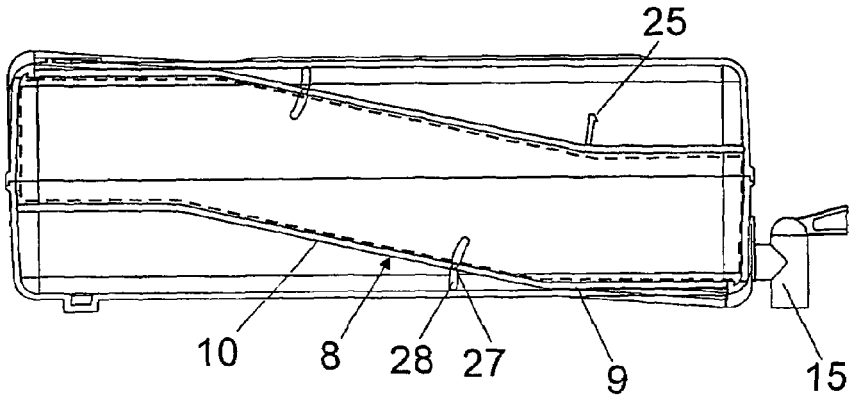

The integral plastics material interconnecting the three zones, and which is indicated by numeral (13), is resiliently flexible so that the primary panel can flex between a position in which it is substantially flush on the bottom of the box and one in which the inclined zone is indeed upwardly inclined with the resilient bias being towards the latter position which is illustrated in FIG. 3.

The forward zone also has a pair of laterally spaced recesses (14) of arcuate shape at their front ends for accommodating the lowermost periphery of a valve or outlet tap (15) of a liquid filled packaging bag located within the box. The bottom of the box has corresponding recesses (16).

In this embodiment of the invention there are two laterally spaced recesses symmetrically positioned about the longitudinal axis of the box and the resultant downwardly extending bulges in the bottom serve as two front feet of the box. The rear of the box is supported on two spaced feet (17) which are adapted to cooperate with co-operant recesses (18) on the outside of the lid to enable vertical alignment of stacked boxes to be easily achieved.

In this embodiment of the invention a pinch panel (19) is also provided and, in order to economize on tools and dies, the pinch panel may be, and in this case is, identical to the primary panel. The pinch panel has a rear zone (20) which is attached to the rear of the lid in exactly the same manner as the forward zone of the primary panel and the two panels cooperate with each other in a manner such that their surfaces may be substantially contiguous from front to back as illustrated most clearly in FIG. 3.

Figure 5:
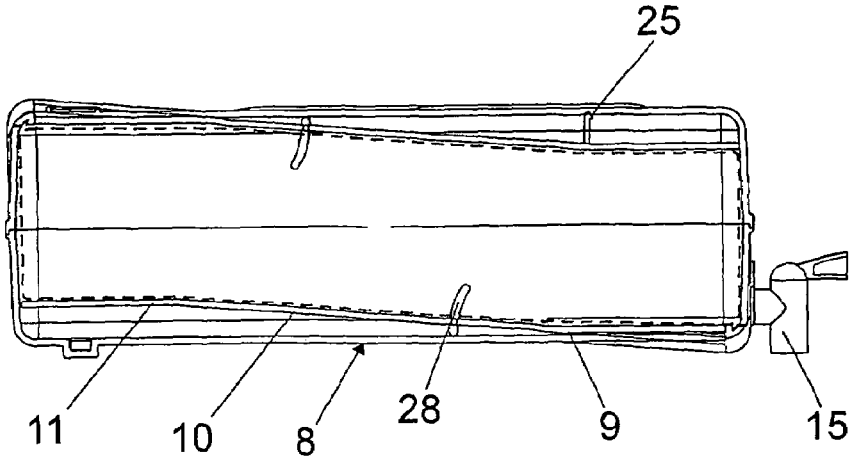
Figure 6:
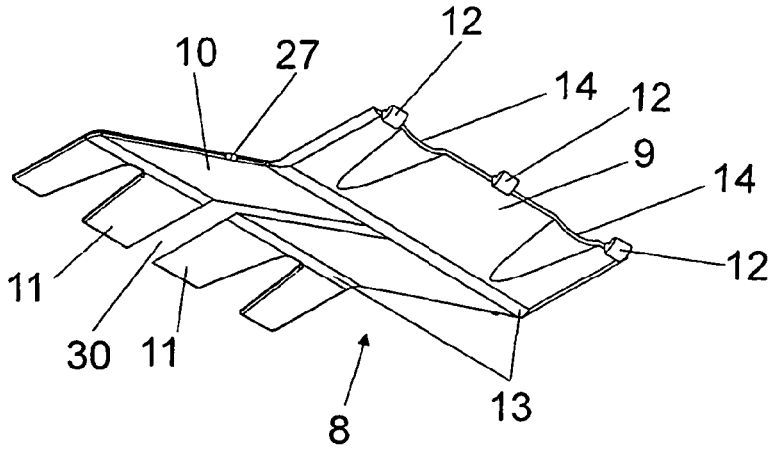
FIG. 6 is an isometric view of the primary panel taken from the underneath of the front edge thereof.
Figure 7:
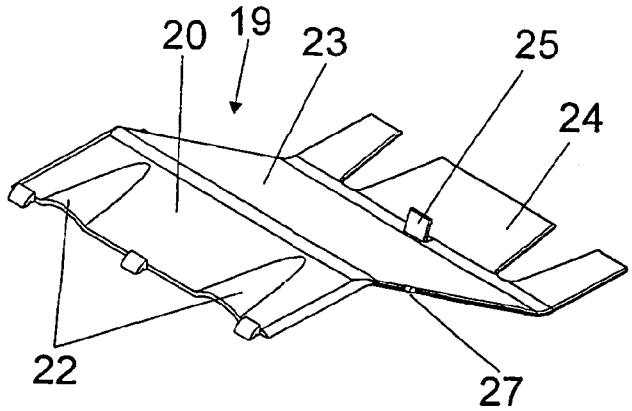
FIG. 7 is an isometric view of the pinch panel taken from the top of the rear edge thereof.

The lid is therefore provided with recesses (21) for accommodating the recesses (22) of the rear zone of the pinch panel. Thus, in its operative horizontal position, the pinch panel will be biased downwards with the primary panel being biased upwards so that a squeezing or pinching effect is achieved on a liquid filled packaging bag located in the box. The liquid in the packaging bag will hold the two panels in a separated condition as illustrated in FIG. 5 and, as the liquid is removed progressively, the primary panel will rise and the pinch panel will move downwards to positions such as those illustrated in FIG. 4, and subsequently to that illustrated in FIG. 3 when the packaging bag is substantially empty.

The pinch panel therefore has a downwardly inclined zone (23) and a forward zone (24) that correspond exactly to the inclined zone (10) and the rear zone (11) of the primary panel. The only difference between the two panels is that the pinch panel may optionally have a catch (25) moulded integral therewith and adapted to cooperate with a slot (26) in the lid to hold the pinch panel against the lid and against its bias for transport and storage purposes so that a continuous pressure is not exerted on the packaging bag until it is required for use. At that stage the catch can simply be manually released to enable the pinch panel to become functional. The primary panel is, in this embodiment of the invention, also moulded with such a catch for production purposes, but the catches are simply broken off as it is unnecessary in the case of the primary panel.

The changing in inclination of the intermediate zones (10) and (23) of the two panels may also be put to good effect by moulding integral therewith lateral projections (27) at each side that extend into arcuate slots (28) through the sidewalls of the box. The position of the projection in the slot will be an indication of the amount of liquid remaining in a packaging bag housed within the box.

It will be understood that, in use, a liquid filled packaging bag located within the box will maintain the primary panel and pinch panel (after the catch has been released) separated and that the two panels will be urged towards each other by the inherent resilience of the plastic material from which they are made. This will tend to urge the liquid out of the packaging bag. Also it will be understood that, as described in my said international patent application, the liquid will tend to flow downwards towards the outlet end of the bag which is foremost and lowermost so that it will be easy and effective to substantially drain the contents of the bag without resorting to any complicated manipulation and holding of the bag and box in various orientations as is the case of most existing arrangements.

The generally flat configuration of the box and the fact that its length extends rearwards enables the optimum use to be made of storage space, for example in refrigerators, whilst dispensing of liquids and semi-liquids contained in a packaging bag within the box will occur efficiently and effectively.

Figure 10:
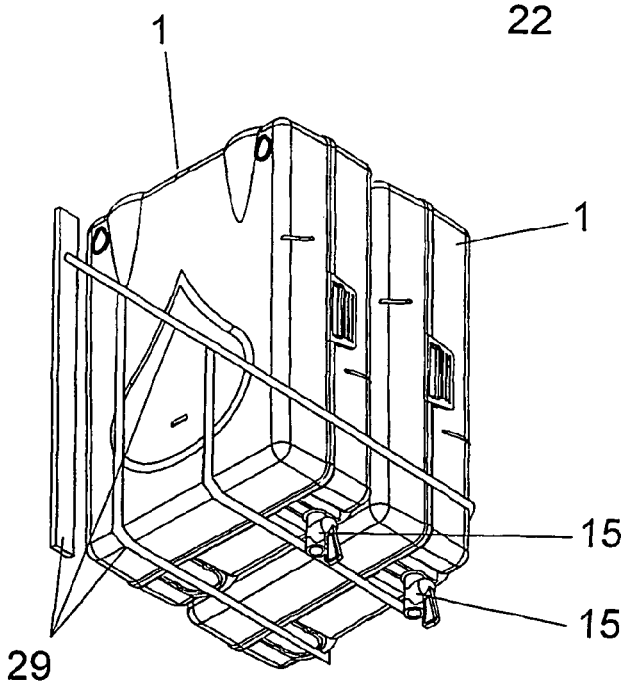

Whilst this orientation of the panel and box assembly according to the invention is envisaged as being the more common, the squeezing action provided by the primary and pinch panels working together can be put to good effect in instances in which the liquid packaged in a flexible packaging bag is rather viscous and does not need to be kept in a refrigerator. In such a case, and as illustrated in FIG. 10, the boxes (1) can be orientated in an upright position with the tap (15) lowermost and a plurality of boxes can be held next each other by means of a bracket (29) secured to a wall, for example. Numerous different configurations of such bracket are possible and various numbers of boxes from one upwards can be supported in a single bracket according to requirements.

Numerous variations may be made to the embodiment of the invention described above without departing from the scope hereof. Such variations may be consequent on requirements for a particular application or in consequence of facilitating manufacture. For example, depending on the plastics material employed, it may be desirable to provide a slot (30) dividing the inclined zone (10, 23) and the rear zone (11, 24) of each of the panels centrally into two in order to accommodate better contraction of the plastics material following on moulding and to lead to more flexibility in application. (The slot is shown only in FIG. 6). Such a panel can, for example, be used to cooperate with, and in the horizontal orientation, to support, two half width flexible packaging bags next to each other with each being squeezed independently of the other between the associated half section of the inclined and rear zones the panels.

Whilst the preferred embodiment of the invention has been described as being made of plastic, it is also within the scope of the invention to make the various components of other materials. In particular, the primary panel and, where appropriate the pinch panel, could be fabricated from spring steel or other suitable resilient material. Also, the box could be pressed or otherwise formed from deformable material; it could be press moulded; or formed in any other way and it could be finished off with many different coating compositions, as may be required.

The invention claimed is:

1. A primary panel for cooperation with a liquid filled flexible packaging bag during withdrawal intermittently of the contents thereof, the primary panel comprising at least a normally inclined zone adapted to flex between a position in which it is generally parallel to a base under conditions corresponding to a full flexible packaging bag and one in which it is inclined relative to the base under conditions corresponding to a partially filled or substantially empty flexible packaging bag and wherein the inclined zone is resiliently biased towards said inclined position, wherein the primary panel has an operatively forward zone adapted for attachment to a base in a relatively fixed forward position with respect to the base and the inclined zone is attached to the forward zone through a flexible zone positioned rearwards of a front edge of the forward zone and wherein the panel is made as a single plastics injection moulding with the flexible zone connecting the forward zone to the inclined zone and being adapted to flex resiliently.

2. A primary panel as claimed in claim 1 in which the inclined zone defines an intermediate zone communicating at its operatively opposite or rear end with a rear zone orientated approximately in a plane parallel to that of the forward zone.

3. A primary panel as claimed in claim 1 in which the forward zone is provided with one or more catches for attaching it to said base.

4. A primary panel as claimed in claim 1 in which the forward zone has one or more recessed regions shaped to accommodate a flange of an outlet tap arrangement that may be associated with a liquid filled flexible packaging bag.

5. A box operatively receiving a primary panel for cooperation with a liquid filled flexible packaging bag during withdrawal intermittently of the contents thereof, the primary panel comprising at least a normally inclined zone adapted to flex between a position in which it is generally parallel to a base under conditions corresponding to a full flexible packaging bag and one in which it is inclined relative to the base under conditions corresponding to a partially filled or substantially empty flexible packaging bag and wherein the inclined zone is resiliently biased towards said inclined position, wherein the primary panel has an operatively forward zone attached to the base in a relatively fixed forward position with respect to the base and the inclined zone is attached to the forward zone through a flexible zone positioned rearwards of a front edge of the forward zone with the forward zone of the primary panel in a generally parallel and generally flush orientation relative to a bottom of the box.

6. A box as claimed in claim 5 in which the box has formations adapted to cooperate with catches on the forward zone of the primary panel in order to retain it in its operative position.

7. A box as claimed in claim 5 in which the bottom of the box has corresponding recesses for receiving recessed regions provided on the forward zone of the primary panel.

8. A box as claimed in claim 5 in which the box has a front wall with one or more openings or removable sections for enabling an outlet tap arrangement to communicate from the interior to the exterior of the box.

9. A box as claimed in claims 5 in which the box has sidewalls at least one half of the height of which is formed integral with the bottom and the remainder of the height of which is formed integral with a lid of the box.

10. A box as claimed in claim 5 in which the sidewalls have a slot formed therein through which the inclination of the inclined zone of a panel can be observed as an indication of the quantity of liquid remaining in the packaging bag.

11. A box as claimed in claim 5 in which the bottom, sidewalls and a lid of the box are made as a single integral plastics moulding with an integral hinge joining the lid part of the box and the bottom part of the box.

12. A box as claimed in claim 5 in which the box has a lid receiving at a rear end thereof a rear zone of a pinch panel having an inclined zone biased towards the primary panel and a forward zone co-operating with the primary panel so that the content of any liquid filled flexible packaging bag located between the two panels is squeezed somewhat by a pinching action between them.

13. A box as claimed in claim 12 in which the pinch panel has a clip for releasably holding it against its bias in a retracted position against the lid pending release thereof for use.

14. A box as claimed in claim 12 in which the primary panel and pinch panel are substantially identical with the forward zone of the primary panel corresponding with, and being identical to, the rear zone of the pinch panel.

15. A box as claimed in claim 5 in which a bracket is provided to support the box in an operatively vertical orientation.

16. A primary panel for cooperation with a liquid filled flexible packaging bag during withdrawal intermittently of the contents thereof, the primary panel comprising at least a normally inclined zone adapted to flex between a position in which it is generally parallel to a base under conditions corresponding to a full flexible packaging bag and one in which it is inclined relative to the base under conditions corresponding to a partially filled or substantially empty flexible packaging bag and wherein the inclined zone is resiliently biased towards said inclined position, wherein the primary panel has an operatively forward zone adapted for attachment to a base in a relatively fixed forward position with respect to the base and the inclined zone is attached to the forward zone through a flexible zone positioned rearwards of a front edge of the forward zone, and in which the inclined zone defines an intermediate zone communicating at its operatively opposite or rear end with a rear zone orientated approximately in a plane parallel to that of the forward zone.

* * * * *